US007137170B1

(12) United States Patent
Morey et al.

(10) Patent No.: US 7,137,170 B1
(45) Date of Patent: Nov. 21, 2006

(54) MANUAL SCRUBBER WITH VACUUM PICK-UP

(75) Inventors: Kevin R. Morey, Perrysburg, OH (US); Russell S. Vander Zwaag, Holland, MI (US)

(73) Assignee: NSS Enterprises, Inc., Toledo, OH (US)

( * ) Notice: Subject to any disclaimer, the term of this patent is extended or adjusted under 35 U.S.C. 154(b) by 519 days.

(21) Appl. No.: 10/353,813

(22) Filed: Jan. 29, 2003
(Under 37 CFR 1.47)

Related U.S. Application Data

(60) Provisional application No. 60/353,339, filed on Feb. 1, 2002.

(51) Int. Cl.
*A47L 7/00* (2006.01)

(52) U.S. Cl. ..... 15/321; 15/401

(58) Field of Classification Search ..... None
See application file for complete search history.

(56) References Cited

U.S. PATENT DOCUMENTS

| | | | | |
|---|---|---|---|---|
| 1,923,689 | A * | 8/1933 | Rosenberg | 15/320 |
| 3,550,181 | A * | 12/1970 | Burgoon et al. | 15/320 |
| 3,663,985 | A * | 5/1972 | Burgoon | 15/320 |
| 4,153,968 | A * | 5/1979 | Perkins | 15/321 |
| 4,741,069 | A * | 5/1988 | Helm et al. | 15/320 |
| 4,809,396 | A * | 3/1989 | Houser | 15/320 |
| 4,893,375 | A * | 1/1990 | Girman et al. | 15/321 |
| 6,105,203 | A * | 8/2000 | Hueppi et al. | 15/320 |

OTHER PUBLICATIONS

Colt FMS Series, NSS Enterprises, Inc., 2000, #9090811, Rev. A Aug. 2000.
Aztec Guzzler Wet Vacuum and Aztec Liquidator solution applicator printed from website entitled www.aztecproducts.com/stripping.htm.
Mop King Mop Machine printed from www.am-king.com.
KaiWhiz, No-Touch Cleaning, Kaivac Inc., printed from www.kaivac.com.
KaiMotion, No-Touch Cleaning, Kaivac Inc., printed from www.kaivac.com.
Nilfisk-Advance Reel Cleaner.
Wrangler 1708/2008 Automatic Scrubber, NSS Enterprises, Inc. 2000, #9091301 Rev. A Sep. 2000.
Fas-Trak Industries, Inc., Strip-Trak stripper applicator.

* cited by examiner

*Primary Examiner*—Theresa T. Snider
(74) *Attorney, Agent, or Firm*—Emch, Schaffer, Schaub & Porcello Co., L.P.A.

(57) ABSTRACT

A compact machine for cleaning floors includes (1) a solution tank and dispensing means for dispensing solution onto the surface to be cleaned, (2) a hose and squeegee assembly for picking up dirty solution, (3) a recovery tank far receiving the dirty solution from said hose, and (4) a vacuum motor communicating with said hose.

5 Claims, 3 Drawing Sheets

MANUAL SCRUBBER WITH VACUUM PICK-UP

CROSS REFERENCE TO RELATED APPLICATION

This application is based upon and claims the benefit of Provisional Patent Application No. 60/353,339 filed Feb. 1, 2002.

BACKGROUND OF THE INVENTION

Conventional tools for cleaning floors range from a mop and bucket to pressure washers to automatic scrubbers. With the mop and bucket, solution is added to the bucket and then a mop made out of absorbent material is used to suck up the solution and then apply it to the floor. The mop is then used as the abrasive tool to break dirt loose from the floor. The dirt from the floor collects in the mop which is then submersed in the solution in the bucket. Dirt is rinsed from the mop by repeated dunking and wringing (usually with a mop wringer).

This process is sub-optimal for a number of reasons. First, dirt from the floor is returned to the bucket causing the solution to become dirtier and dirtier such that an area cleaned towards the end of the process is never as clean as the first area cleaned. Some mop buckets exist today that have a solution tank and a rinse tank which helps to keep the solution clean for a longer period of time, but dirt is still carried into the solution tank by the mop.

Secondly, absorbent mops required to lift solution out of the bucket and onto the floor do not make very good scrubbers. Ideally, an abrasive pad or bristle brush is used to break dirt free, but they do not absorb water and cannot be used to get the water from the bucket to the floor or dirty water from the floor back to the bucket. Sponge and abrasive pad combinations that accomplish both tasks are common for cleaning in a domestic setting, but are rarely used in commercial environments since floor coverage is too great and capacity to hold dirt is insufficient.

Pressure washers utilizing high-pressure pumps rely on the high-pressure discharge of cleaning solution as a means to break dirt free. Pressure washers are available with vacuum capability to recover the solution and the dirt as it is sprayed. These systems used a significant amount of water and are expensive and more difficult to use and maintain then the manual scrubber at the present invention.

With automatic scrubbers, solution is dispensed to the floor, scrub pads or brushes driven by motors break the dirt free, and a vacuum and squeegee return the dirty solution to a separate tank leaving the solution clean from start to finish. However, like pressure washers, automatic scrubbers are significantly more expensive and more difficult to operate and maintain. Additionally, automatic scrubbers are hard to maneuver in tight places and are incapable of cleaning under low profile objects (shelves, tables, chairs, etc.). Some automatic scrubbers have wand accessories with or without powered brushes for reaching in these tight spots, but such application sub-optimizes its performance as they are designed to scrub large, unobstructed areas.

SUMMARY OF THE INVENTION

The present invention is a vast improvement over the mop and bucket, yet is much less expensive than the pressure washer and automatic scrubber. It is also easier to use and maintain. The present invention includes (1) a solution tank and a dispensing system to apply the solution to the floor, (2) a scrubbing tool having an abrasive pad or brush on a handle for scrubbing the surface being cleaned, and (3) a vacuum motor that produces suction through a squeegee tool to suck the dirty solution into a recovery tank. The only component requiring power is the vacuum motor. As a result, the machine of the present invention is simple, reasonably priced, and easy to use and maintain. Yet it is very effective at dispensing solution, keeping clean and dirty solutions separate, and picking up the dirty solution. Variations on solution feed, scrubbing tool, and squeegee configurations are described below.

It is an object of the present invention to provide an efficient and yet economical scrubber which can be manually operated.

Other objects and advantages of the present invention will become apparent to those skilled in the art upon a review of the following detailed description of the preferred embodiments and the accompanying drawings.

DESCRIPTION OF THE PREFERRED EMBODIMENT

Figure 1:
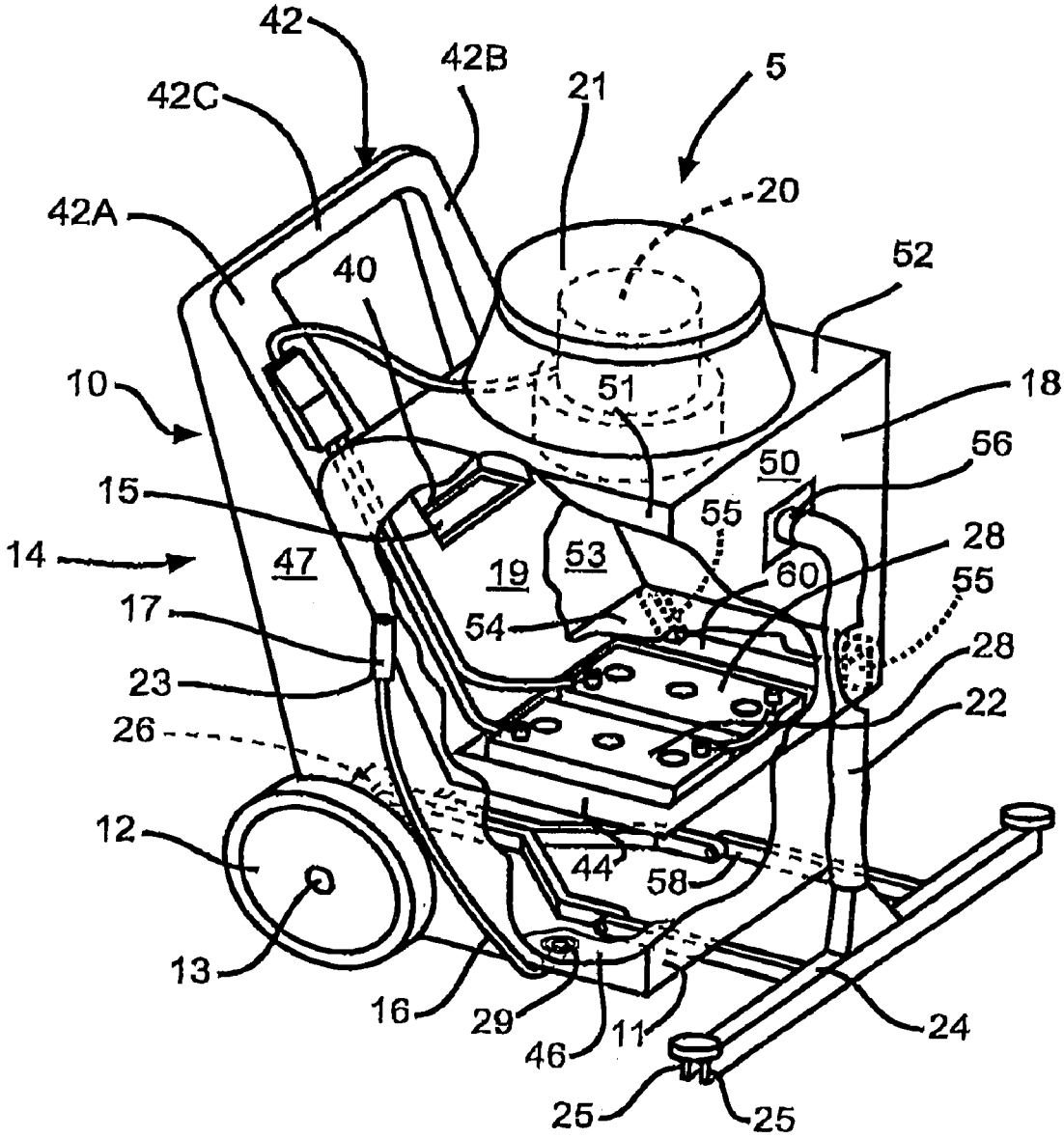
FIG. 1 is a perspective view of one embodiment of the present invention.

Referring to FIG. 1, there is provided a scrubber 5 having a cart 10 with wheels 12 mounted on an axle 13 an the beck and casters (not shown) on the front. The cart 10 may be rotationally molded from one of a variety of plastic materials such as high density polyethylene. Since the cart 10 is rotationally molded, it can be provided with a cleaning solution tank 14 portion which preferably extends from the back of the cart 10 adjacent the wheels 12 to the front 11. Located at the back of the cart 10 over the wheels 12 is a horizontal transverse wall 40 having an opening 15 for introducing cleaning solution into the tank 14. Extending upwardly from the wall 40 are a pair of spaced apart upright portions 42A and 42B cooperating with a transverse gripping portion 42C to form an integral unitary handle 42. The solution tank 14 includes a tapered wall 19 extending downwardly at an angle toward the front 11 to a horizontal wall 60 defining the top of the solution tank 14 in the area between the front 11 and the tapered wall 19. The solution tank 14 also includes integral unitary bottom 46, sides 47, (only one of which can be seen in FIG. 1) and a back.

A discharge hose 16 is coupled to a dispensing outlet 29 at the lowest point of the solution tank 14 at or adjacent the bottom 46. The hose 16 extends to a discharge end 17 and is long enough to reach the top of the solution tank 14. When discharging cleaning solution, the operator holds the discharge hose 16 copse to the floor allowing solution to flow onto the floor through an expulsion outlet at the discharge end 17. When not discharging cleaning solution, the hose 16 is fastened by a clip 23 in an upright orientation such that the discharge end 17 is above the level of cleaning solution in the tank 14 and, therefore, will not discharge such solution.

Mounted on the cart 10 is a recovery tank 16. The recovery tank 18 includes a front wall 50, side walls 51, a top wall 52, a tapered rear wall 53 resting upon the tapered wall 19 of the solution tank 14 and a bottom wall 54. The bottom wall is spaced from the horizontal wall 60 of the solution tank 14 and is supported thereon by posts 55. Near its upper portion, the front wall 50 has an inlet opening 56 to which is connected a recovery hose 22.

The recovery hose 22 is attached to a squeegee assembly 24 positioned near the front 11 of the cart 10. The squeegee assembly 24 is supported on a pair of arms 58 which may be raised or lowered by a lift mechanism 26 of one of several types well known in the art, which lift mechanism may be positioned at the rear between the wheels 12. The squeegee assembly 24 supports a pair of spaced apart squeegee blades 25 which contact the floor being cleaned when the arms 58 and squeegee assembly 24 are in the lowered position.

Mounted on the top wall 52 of a recovery tank 18 is a vacuum motor 20 which communicates with the recovery tank 18. A lid 21 encapsulates the vacuum motor 20. One or more batteries 28 are mounted on the cart 10, resting in a recess 44 in the solution tank 14 and below the recovery tank 18. The battery or batteries 28 provide power for the vacuum motor 20. The vacuum motor 20 communicates with the recovery hose 22 through the recovery tank 18 and sucks air and water through recovery hose 22 attached to the squeegee 24.

During operation, the operator dispenses cleaning solution by gravity to the floor, scrubs the wetted area with a brush or scrub pad, then sucks the dirty water into the recovery tank 18 by lowering the squeegee assembly 24 to the floor and pushing the cart 10 (and squeegee blades 25) through the puddles of dirty solution. The two spaced apart squeegee blades 25 provide a confined area to enhance the vacuum pick-up of dirty solution and directing such dirty solution to the recovery hose 22 and recovery tank 18. In dispensing the solution from the solution tank 14, the operator simply removes the end 17 of the discharge hose 16 from the clip 23 and lowers it to a position at which the cleaning solution will flow therefrom by gravity.

If desired a valve may be incorporated into the discharge hose 16 to turn on and off the flow of cleaning solution.

If desired, the tank containing the cleaning solution could be positioned above the batteries and/or vacuum motor 20 and/or recovery tank 18 thereby raising the lowest point of the solution tank and enabling the operator to gravity feed cleaning solution to the floor without having to bend over so far.

Additionally, if desired, the recovery hose 22 communicating with the vacuum motor 20 may be attached to a wand type tool that has a brush or scrubber on one side and a vacuum squeegee arrangement on the other instead of being attached to a squeegee assembly 24 mounted on the front of the cart 10. The operator then scrubs the surface with the brush side and then flips the wand over to suck up the dirty water.

Figure 2:
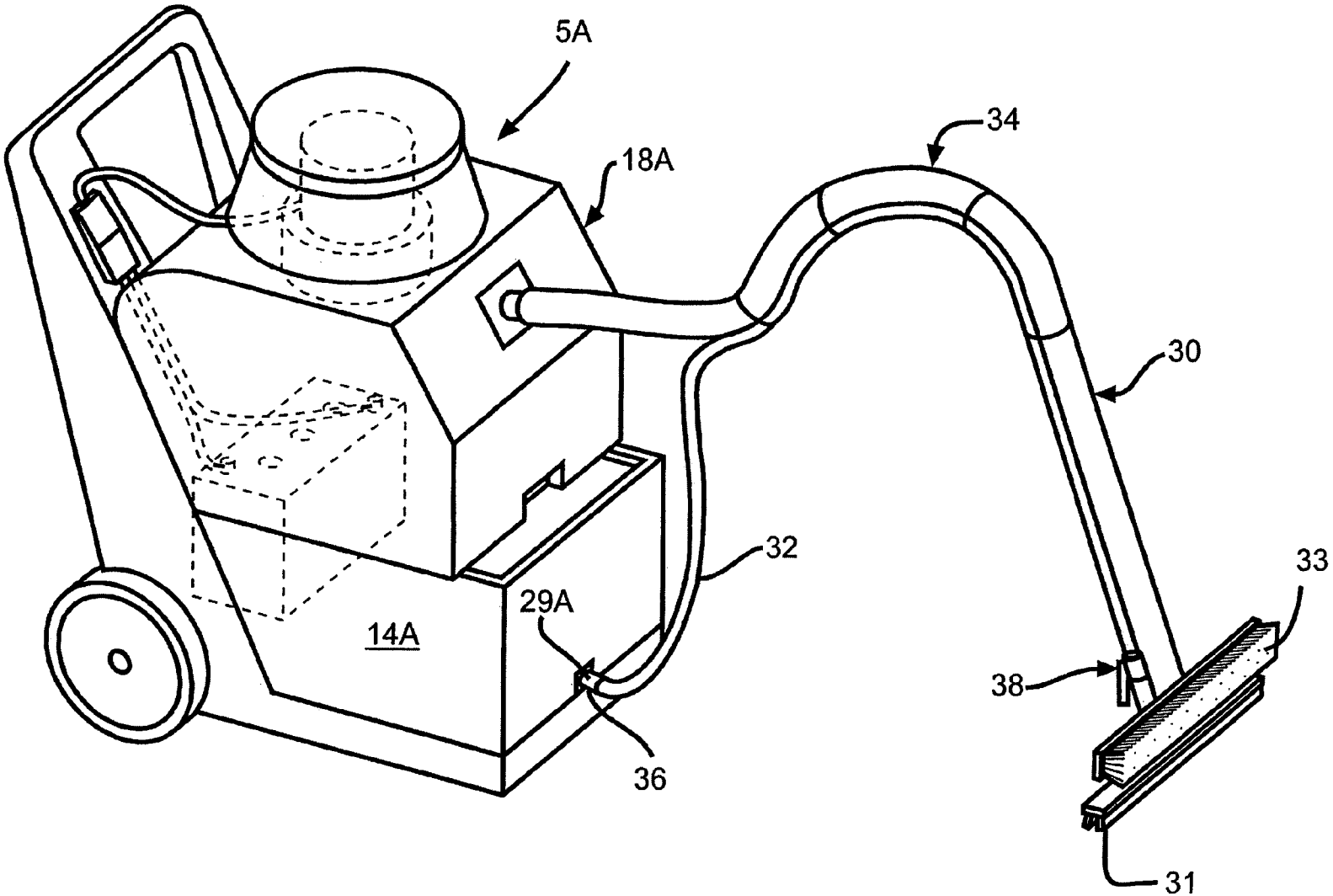
FIG. 2 is a perspective view of a second embodiment.

Referring to FIG. 2, there is shown a second embodiment of scrubber 5A is similar to the first in that it has a lower cleaning solution tank 14A and an upper recovery tank 18A. Under the second embodiment, there is provided a hand-held brush/squeegee wand assembly 30 to which is connected both (1) a discharge hose 32 to receive and discharge cleaning solution from the solution tank 14A and (2) a vacuum recovery hose 34 for directing dirty water picked up by the brush/squeegee wand assembly 30 to the recovery tank 18A. The discharge hose 32 is attached to a dispensing outlet 29A at the bottom of the solution tank 14A. A brush 33 is also part of the wand assembly 30 and is positioned adjacent the squeegee 31.

A check valve 36 is incorporated in the solution discharge hose 32 at the end adjacent the dispensing outlet 29A of tank 14A. The check valve is one which permits solution to flow only in a direction away from the solution tank 14A and prevents solution in the hose 32 from returning to the solution tank 14A. A second valve, namely a shut-off valve 38 to adjust or stop flow is incorporated near the outlet or expulsion end of the hose 32 adjacent the brush 33 of the wand 30 held by the operator. The check valve 36 ensures that once the solution discharge hose 32 is filled with solution following initial opening of shut-off valve 38 and lowering of discharge hose 32 to a position where it can become filled with solution to dispense the solution, it will remain full until the solution tank 14A is emptied, assuming of course, that the shut-off valve 38 is in the closed position or the expulsion end of the hose 32 is above the solution level in the solution tank 14A. When the end of the wand 30 is applied to the floor, the end or the solution discharge hose 32 will be lower than the solution level in the tank 14A causing the solution to flow by gravity onto the floor as a siphoning action.

Figure 3:
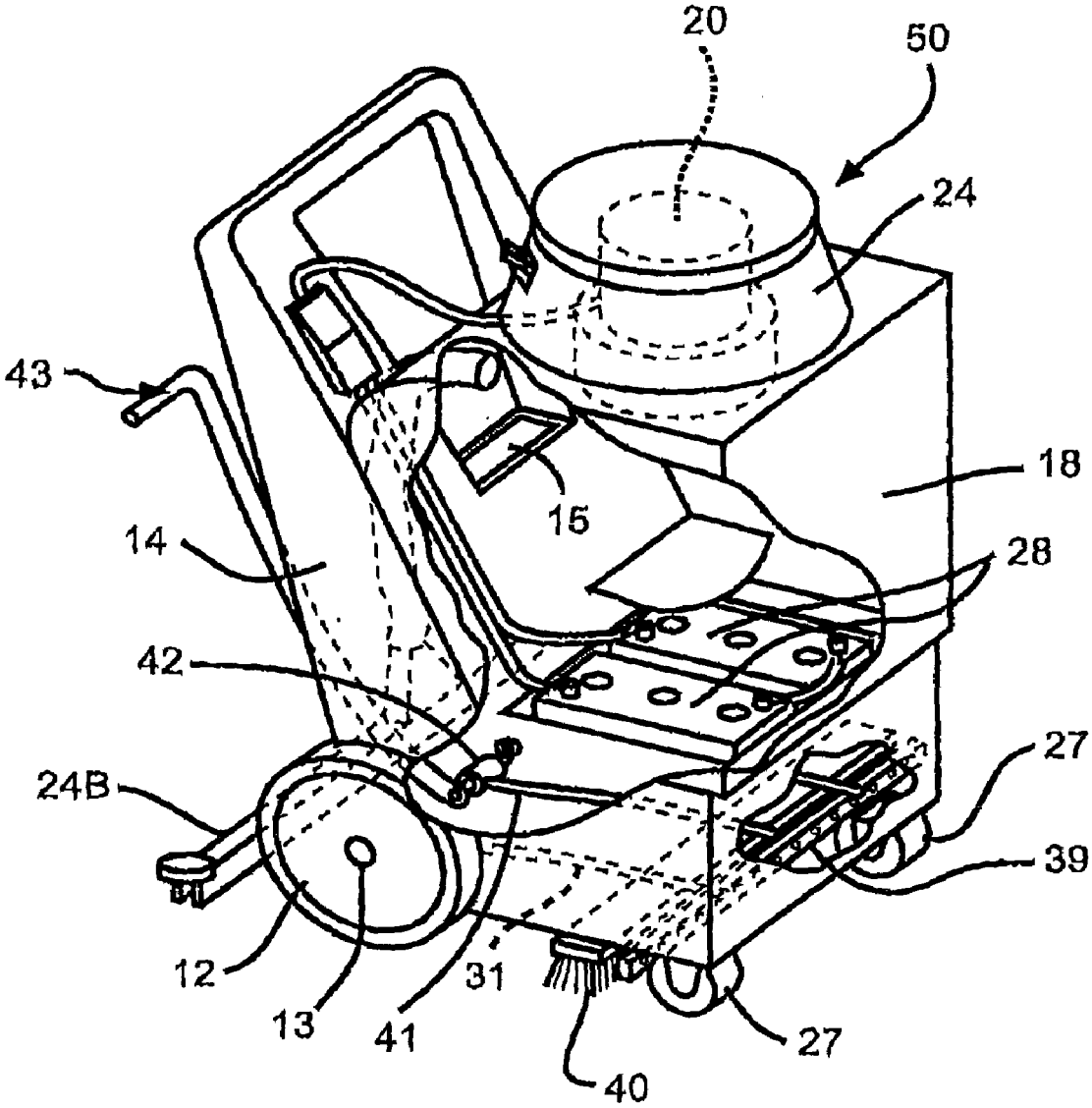
FIG. 3 is a perspective view of a third embodiment.

Referring to FIG. 3, there is shown a third embodiment of manual scrubber 50, which is similar to the first embodiment in that it has a rotationally molded cart 10 with a cleaning solution tank 14, a recovery tank 18, a vacuum motor 20 on the recovery tank 18 and batteries 28 mounted on a recess of the solution tank 14. The scrubber 50 is provided with a squeegee assembly having a solution dispenser bar 39 and brush 40 mounted under the cleaning solution tank 14 immediately behind casters 27 at the front of the solution tank 14. The solution is fed from the solution tank 14 via a discharge hose 41 having one end connected to the solution tank 14 and the other end connected to the dispenser bar 39. Incorporated in the discharge hose 41 is a shut-off valve 42 to control the flow of cleaning solution from the solution tank 14 to the dispenser bar 39. A shut-off valve actuator 43 is manually operable to open and close the shut-off value 42. Both the brush 40 and solution dispenser bar 39 are attached to arms 31 pivotally connected to the rear axle 13 such that the brush 40 is always in contact with the floor while performing the scrubbing operation. The arm 31 can be locked in an up position for transport, and also can be spring loaded or weighted to attain the desired pressure against the floor. The squeegee assembly can be mounted at the front of the scrubber similar to that shown in FIG. 1, or at the rear of the machine as squeegee assembly 24B, shown in FIG. 3 depending on whether a pull or push operation is desired.

The above detailed description of the present invention is given for explanatory purposes. It will be apparent to those skilled in the art that numerous changes and modifications can be made without departing from the scope of the invention.

We claim:

1. Apparatus for cleaning a surface comprising (a) a first tank for containing a cleaning solution; said first tank having a discharge port positioned to effect dispensing of said cleaning liquid therefrom solely by gravity to said surface;

(b) a first tubular member for receiving cleaning solution from said discharge port, said first tubular member including an expulsion outlet spaced from said discharge port, said first tubular member being releasably attached adjacent said expulsion outlet to connector means positioned above said discharge port and being movable to move said expulsion outlet (i) from a position permitting said solution to flow by gravity from said discharge port to and through said expulsion outlet to said surface (ii) to a position preventing the flow of said solution by gravity;

(c) a second tank for receiving dirt and said cleaning solution following its being dispensed to said surface;

(d) a squeegee assembly positioned for engagement with said surface;

(e) a second tubular member connected to said squeegee assembly and to said second tank; and (f) a vacuum motor communicating with said second tubular member to cause dirt and cleaning solution contacted by said squeegee assembly to be directed to said second tank.

2. Apparatus for cleaning a surface comprising (a) a housing having a compartment for containing a liquid cleaning solution, said compartment having a dispensing outlet positioned to permit the flow of cleaning solution therethrough by gravity;

(b) a first tubular member connected to said dispensing outlet for receiving cleaning solution from said dispensing outlet, said first tubular member including an expulsion outlet spaced from said dispensing outlet, said first tubular member being releasably attached adjacent said expulsion outlet to connector means positioned above said dispensing outlet and being movable to move said expulsion outlet (i) from a position permitting said solution to flow by gravity from said dispensing outlet to and through said explusion outlet to said surface (ii) to a position preventing the flow of said solution by gravity;

(c) a fluid recovery tank connected to said housing;

(d) a wand assembly including (i) a squeegee member for engaging said surface and said solution on said surface, (ii) a second tubular member connected to said recovery tank for directing said solution from said surface to said recovery tank and (iii) a brush assembly adjacent said squeegee member, said expulsion outlet being positioned to deliver cleaning solution to said brush assembly; and (e) a vacuum pump communicating with said squeegee assembly for effecting the flow of cleaning solution from said surface, to said second tubular member and to said recovery tank.

3. Apparatus according to claim 2 further including a check valve in said first tubular member adjacent said dispensing outlet, said check valve permitting the flow of said solution from said compartment toward said wand assembly but preventing the flow of said solution from said first tubular member to said compartment.

4. Apparatus according to claim 3 further including a shut-off valve for controlling the flow of said solution in said first tubular member, said shut-off valve being positioned between said check valve and said wand assembly.

5. Apparatus according to claim 4 wherein said shut-off valve is positioned adjacent said wand assembly.

* * * * *